US006908180B2

(12) United States Patent
Dietl

(10) Patent No.: US 6,908,180 B2
(45) Date of Patent: Jun. 21, 2005

(54) INK DELIVERY APPARATUS FOR INKJET PRINTHEAD

(75) Inventor: Steven J. Dietl, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 47 days.

(21) Appl. No.: 10/373,257

(22) Filed: Feb. 24, 2003

(65) Prior Publication Data

US 2004/0165039 A1 Aug. 26, 2004

(51) Int. Cl.[7] ..... B41J 2/175
(52) U.S. Cl. ..... 347/85
(58) Field of Search ..... 347/84, 85, 86, 347/87; 137/383, 385, 852

(56) References Cited

U.S. PATENT DOCUMENTS

| | | | | |
|---|---|---|---|---|
| 2,685,301 A | | 8/1954 | Dreier | |
| 4,509,062 A | | 4/1985 | Low et al. | |
| 5,136,309 A | * | 8/1992 | Iida et al. | 347/7 |
| 5,650,811 A | | 7/1997 | Seccombe et al. | |
| 5,844,577 A | | 12/1998 | Pawlowski | |
| 5,844,579 A | * | 12/1998 | Barinaga et al. | 347/7 |
| 5,872,584 A | | 2/1999 | Hauck et al. | |
| 5,975,689 A | | 11/1999 | Pawlowski, Jr. et al. | |
| 5,980,028 A | * | 11/1999 | Seccombe | 347/85 |
| 6,084,617 A | | 7/2000 | Balazer | |
| 6,257,714 B1 | | 7/2001 | Seccombe | |
| 6,267,473 B1 | * | 7/2001 | Smith | 347/85 |
| 6,293,665 B1 | | 9/2001 | Pew et al. | |
| 6,478,415 B2 | * | 11/2002 | Barinaga et al. | 347/85 |
| 2002/0154181 A1 | | 10/2002 | Yoshiyuki et al. | |

FOREIGN PATENT DOCUMENTS

EP 1 120 259 A 8/2001

* cited by examiner

*Primary Examiner*—Anh T. N. Vo
(74) *Attorney, Agent, or Firm*—Roger H. Fields; Mark G. Bocchetti

(57) ABSTRACT

An ink delivery apparatus for an inkjet printhead, comprising an ink reservoir for delivering some ink at a slight negative pressure to a printhead, and a pressure regulator and ink replenishment mechanism that maintains substantially constant negative pressure in the reservoir when some ink in the reservoir is delivered to the printhead and in response to the ink delivery replenishes some ink to the reservoir from an ink supply source, is characterized in that: the pressure regulator and ink replenishment mechanism includes a pressure regulator member that air-tightly covers an opening in the reservoir and is compliant to maintain substantially constant negative pressure in the reservoir, and a replenishment activator connected to the pressure regulator member outside the reservoir to avoid being exposed to the ink and which initiates ink replenishment to the reservoir when some ink in the reservoir is delivered to the printhead.

25 Claims, 4 Drawing Sheets

INK DELIVERY APPARATUS FOR INKJET PRINTHEAD

FIELD OF THE INVENTION

The invention generally relates to inkjet printing, and more particularly to an ink delivery apparatus for an inkjet printhead.

BACKGROUND OF THE INVENTION

Inkjet printers can be divided into two major categories, commonly referred to as continuous inkjet and drop-on-demand (DOD) ink-jet.

In DOD inkjet printers, the ink delivery apparatus for an ink-jet printhead delivers the ink to the printhead at a slight vacuum or negative pressure known as a "back pressure". The slight negative pressure in the printhead is desired because it prevents the ink from leaking, i.e. drooling, out of closely spaced ink discharge nozzles in the printhead, by tending to draw the ink at the nozzles back into the printhead. Moreover, it forms a slightly concave ink meniscus at each nozzle which helps to keep the nozzle clean. Typically, as stated in prior art U.S. Pat. No. 5,650,811 issued Jul. 22, 1997, the slight negative pressure in the printhead may be approximately two to three inches of water below atmospheric pressure. The patent also states that the slight negative pressure can be created by positioning an ink reservoir for the printhead below the printhead. Alternatively, the slight negative pressure can be created by using a nonlinear spring to pull a membrane bladder outward at an opening in an ink reservoir above the printhead. This latter approach is described in detail in U.S. Pat. No. 4,509,062 issued Apr. 2, 1985.

Today, most DOD inkjet printheads have an "onboard" ink reservoir. In other words, the ink reservoir is fixed atop the printhead and moves with it during the printing operation. Often, as disclosed in prior art U.S. Pat. No. 5,975,689 issued Nov. 2, 1999 and U.S. Pat. No. 5,872,584 issued Feb. 16, 1999, the negative pressure regulator is coupled with an ink replenishment mechanism, both of which are located inside the ink reservoir. However, a problem that can occur with locating the negative pressure regulator and ink replenishment mechanism inside the reservoir is that it is subject to corrosion and chemical attack by the ink inside the reservoir. Also, the mechanism may contaminate the ink.

SUMMARY OF THE INVENTION

An ink delivery apparatus for an inkjet printhead, comprising an ink reservoir for delivering some ink at a slight negative pressure to a printhead, and a pressure regulator and ink replenishment mechanism that maintains substantially constant negative pressure in the reservoir when some ink in the reservoir is delivered to the printhead and in response to the ink delivery replenishes someink to the reservoir from an ink supply source, is characterized in that:

the pressure regulator and ink replenishment mechanism includes a pressure regulator member that air-tightly covers an opening in the reservoir and is compliant to maintain substantially constant negative pressure in the reservoir, and a replenishment activator connected to the pressure regulator member outside the reservoir to avoid being exposed to the ink and which initiates ink replenishment to the reservoir when some ink in the reservoir is delivered to the printhead.

DETAILED DESCRIPTION OF THE INVENTION

The invention is depicted as embodied in a drop-on-demand (DOD) inkjet printer. Because the features of such a printer are generally known, the description which follows is directed in particular only to those elements forming part of or cooperating with the disclosed embodiment of the invention. It is to be understood, however, that other elements not disclosed may take various forms known to a person of ordinary skill in the art.

Figure 1:
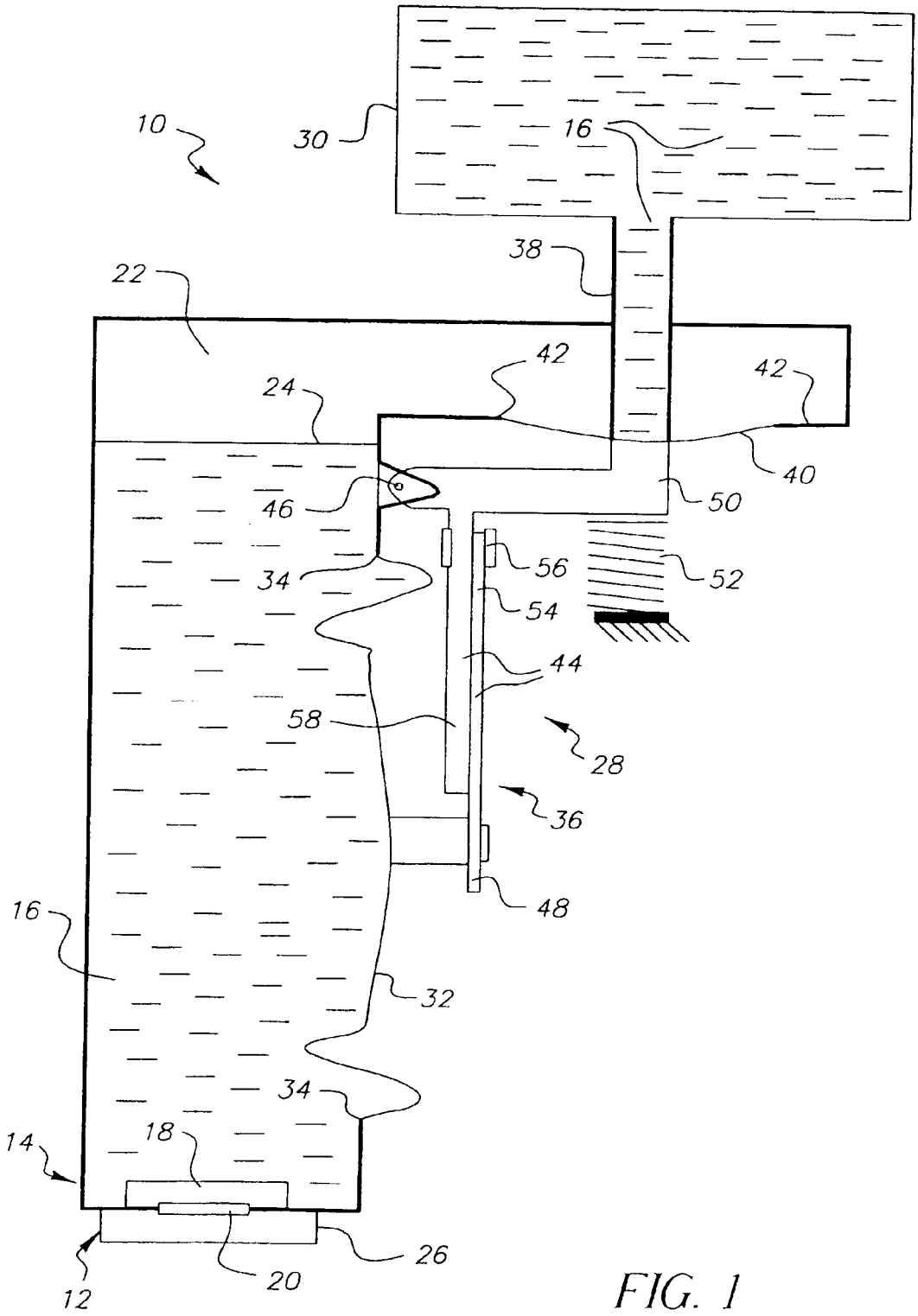
FIGS. 1–3 are elevation views, partly in section, of an ink delivery apparatus according to a preferred embodiment of the invention, illustrating operation of the apparatus.

FIG. 1 shows an ink delivery apparatus 10 for an DOD ink-jet printhead 12. The ink delivery apparatus 10 includes a closed ink reservoir or ink accumulating chamber 14 fixed atop the printhead 12. An ink 16 in the reservoir 14 is intended to drain first through a filter 18 and then through a bottom slot 20, and into the printhead 12. A slight-vacuum airspace 22, i.e. one that is slightly below atmospheric pressure, exists above the ink level 24 in the reservoir. This is consistent with the known need to deliver the ink 16 to the printhead 12 at slight negative pressure known as a "back pressure". Typically, as stated in prior U.S. Pat. No. 5,650,811 issued Jul. 22, 1997, the slight negative pressure in the printhead 12 may be approximately two to three inches of water below atmospheric pressure. The slight negative pressure is desired because it prevents the ink 16 from leaking, i.e. drooling, out of closely spaced ink discharge nozzles (not shown) in a nozzle plate 26 in the printhead 12, by tending to draw the ink at the nozzles back into the printhead. Moreover, it forms a slightly concave ink meniscus at each nozzle which helps to keep the nozzle clean.

A pressure regulator and ink replenishment mechanism 28 maintains substantially constant negative pressure in the reservoir 14 when some ink 16 in the reservoir is delivered to the printhead 12, and in response to the ink delivery replenishes some ink to the reservoir from a pressurized ink supply source 30. This an be seen by comparing FIGS. 1 and 2.

Figure 2:
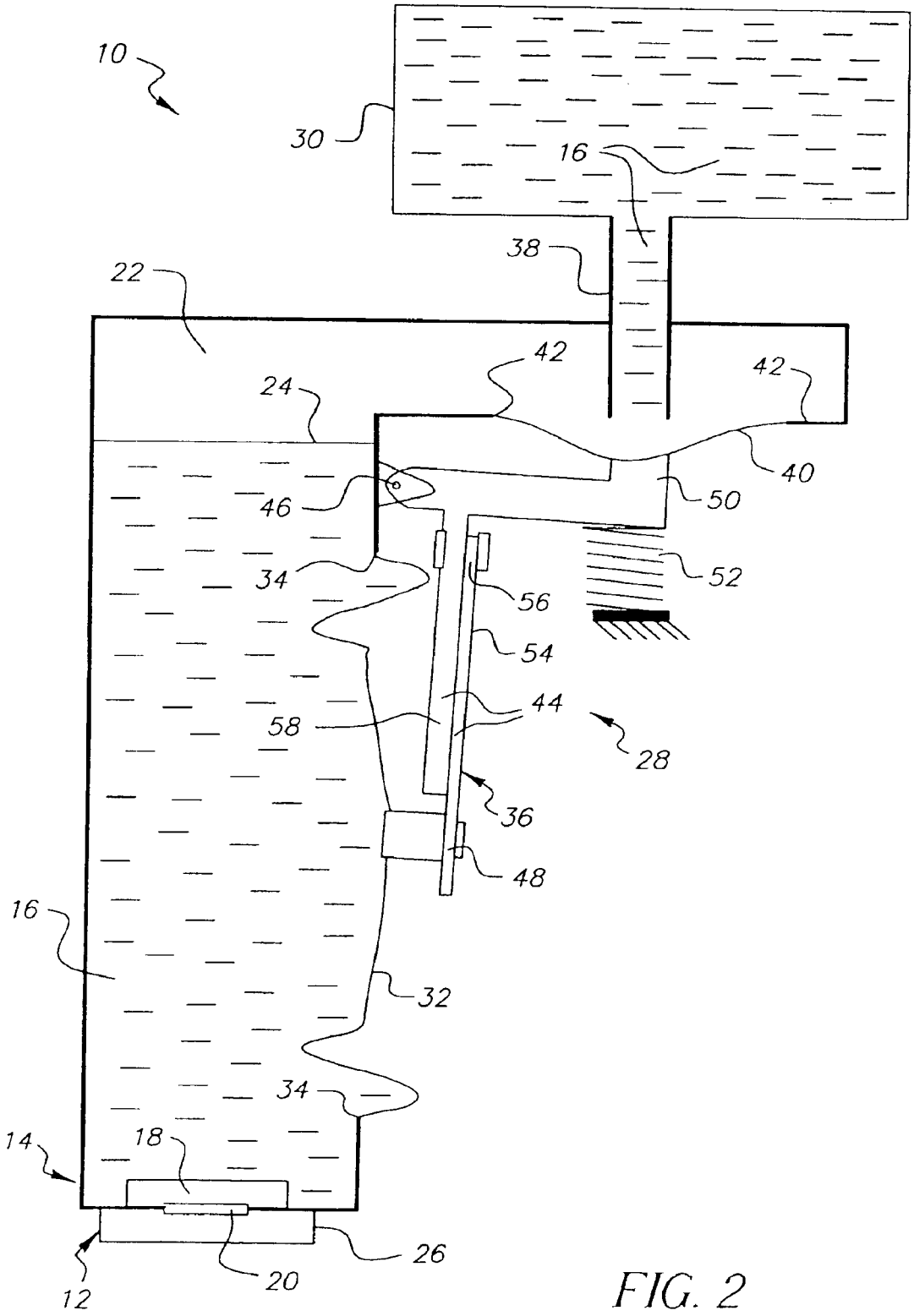

The pressure regulator and ink replenishment mechanism 28 includes a pressure regulator membrane or diaphragm 32 that air-tightly covers an opening 34 in the reservoir 14. The pressure regulator membrane 32 is compliant in order to maintain substantially constant negative pressure in the reservoir 14 by deforming inwardly as shown in FIG. 2, when some ink 16 is delivered to the printhead, and by returning outwardly as shown in FIG. 1, when some ink is replenished to the reservoir. Also, there is included a replenishment activator 36 that is connected to the pressure regulator membrane 32 outside the reservoir 14 to avoid being exposed to the ink 14. The replenishment activator 36 initiates ink replenishment to the reservoir 14 when the pressure regulator membrane 32 deforms inwardly as shown in FIG. 2 and terminates ink replenishment when the pressure regulator membrane returns outwardly as shown in FIG. 1.

An ink conduit 38, such as a tube, longitudinally extends from the pressurized ink source 30 into the reservoir 14. The ink conduit 38 empties into the reservoir 14 as shown in FIG. 2.

The replenishment activator 36 includes a valve membrane or diaphragm 40 that air-tightly covers an opening 42 in the reservoir 14. The valve membrane 40 is compliant to normally cap or close the ink conduit 38 substantially at the opening 42 as shown in FIG. 1, to prevent ink replenishment to the reservoir, and to be stretched to uncap or open the ink conduit as shown in FIG. 2, to allow ink replenishment to the reservoir. The replenishment activator 36 includes a rocker lever 44 that is pivotally mounted via a pivot pin 46 on the reservoir 14 and has a lever portion 48 connected to the pressure regulator membrane 32 and a lever portion 50 connected to the valve membrane 40. The rocker lever 44 thus interconnects the pressure regulator membrane 32 and the valve membrane 40 to pivot clockwise about the pivot pin 46 as shown in FIG. 2, to cause the valve membrane to uncap the ink conduit 38 when the pressure regulator membrane deforms inwardly, and to pivot counterclockwise about the pivot pin as shown in FIG. 1, to recap the ink conduit when the pressure regulator membrane returns outwardly.

A spring 52 applies a counterclockwise pivoting force in FIG. 1 to the rocker lever 44 that causes the end portion 50 of the rocker lever which is connected to the valve membrane 40 to hold the valve membrane capping the ink conduit 30. The pivoting force is light enough to be overcome when the pressure regulator membrane 32 deforms inwardly as shown in FIG. 2.

Figure 3:
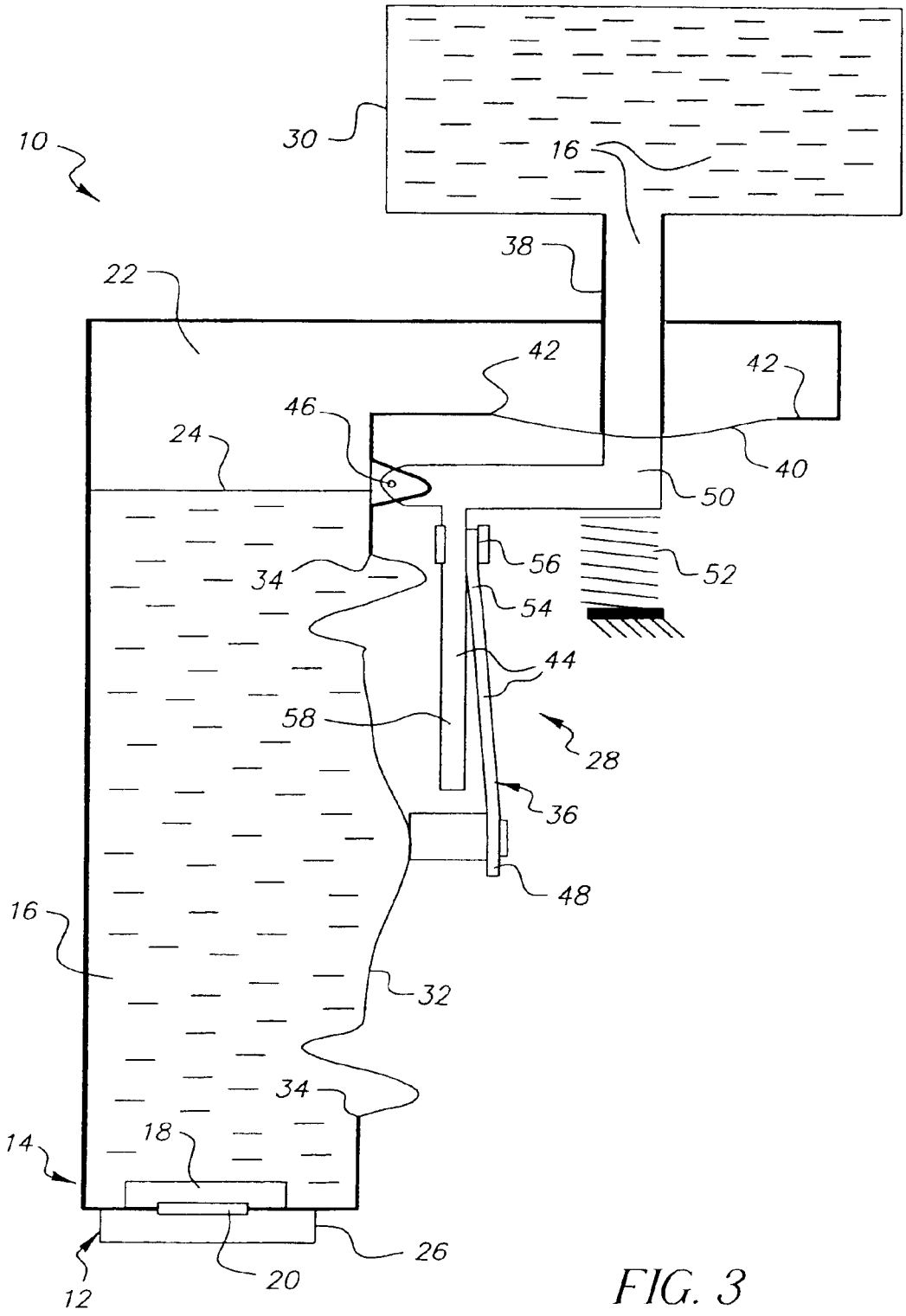

The portion 48 of the rocker lever 44 that is connected to the pressure regulator membrane 32 is actually the free end of a cantilevered leaf spring 54 whose other end 56 is anchored to a rigid rocker arm 58. The rocker arm 58 has a free end that is the portion 50 of the rocker lever which is connected to the valve diaphragm 40. As shown in FIG. 3, the leaf spring 54 permits the portion 48 to be deformed away from the rocker arm 58, without pivoting the rocker lever 44 about the pivot pin 46, should the pressure regulator membrane 32 be further deformed outwardly (beyond its outward deformation in FIG. 1) when the valve membrane 40 is capping the ink conduit 38. The pressure regulator membrane 32 might further deform outwardly in this instance due to a slight increase in the atmospheric pressure or a heating of the ink 16 in the reservoir 14.

Figure 4:
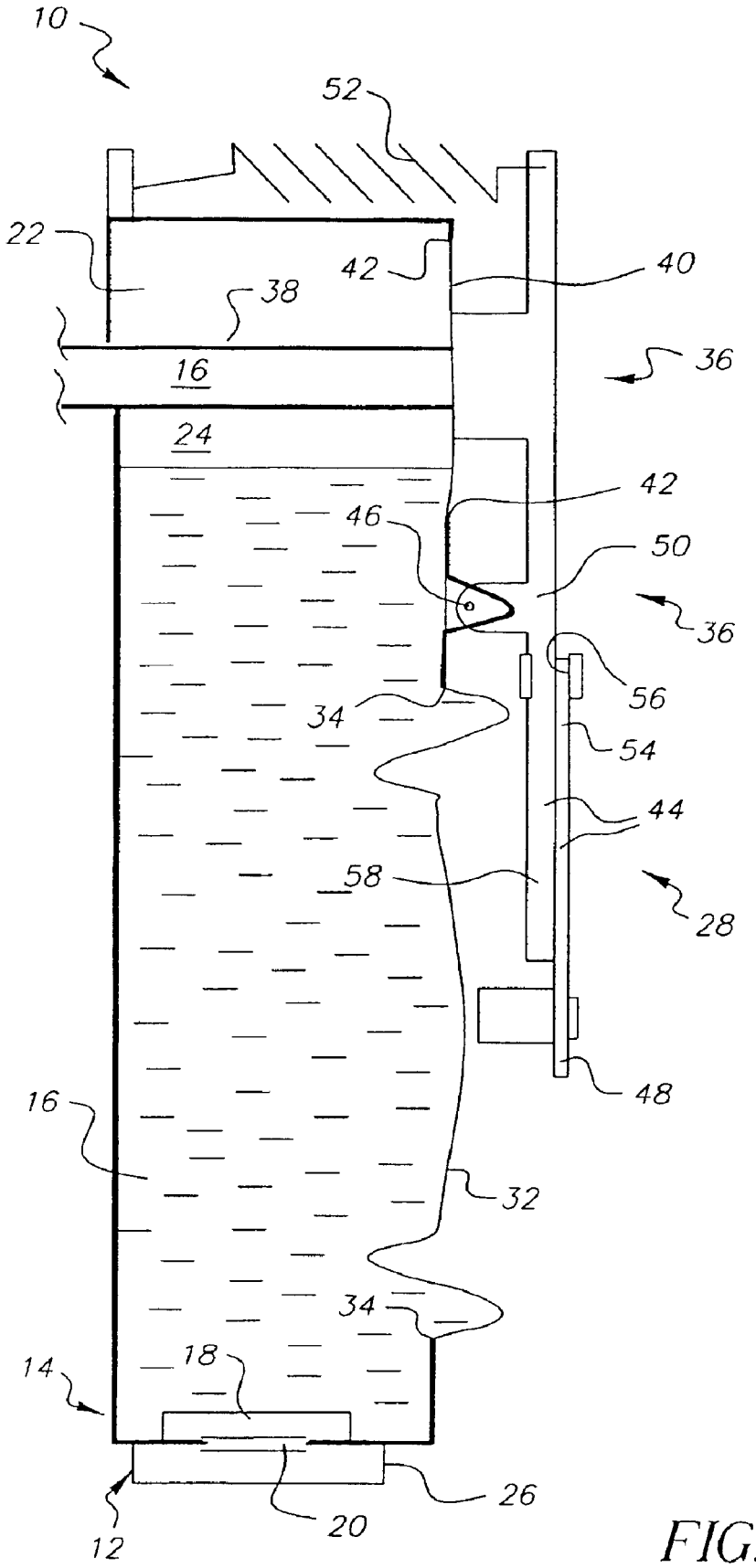
FIG. 4 is an elevation view, partly in section, of an alternate embodiment of the ink delivery apparatus.

FIG. 4 shows an embodiment of the ink delivery apparatus 10 which is a modified version of the one shown in FIGS. 1–3. In FIG. 4, elements that are the same as in FIGS. 1–3 have the same reference numbers. One distinction however is that the spring 52 in FIG. 4 is a helical tension spring, whereas the spring 52 in FIGS. 1–3 is a helical compression spring.

The invention has been described in detail with particular reference to certain preferred embodiments thereof, but it will be understood that variations and modifications can be effected within the spirit and scope of the invention.

Parts List

10. ink delivery apparatus
12. inkjet printhead
14. ink reservoir
16. ink
18. filter
20. bottom slot
22. airspace
24. ink level
26. nozzle plate
28. pressure regulator and ink replenishment mechanism
30. ink supply source
32. pressure regulator membrane
34. opening
36. replenishment activator
38. ink conduit
40. valve membrane
42. opening
44. rocker lever
46. pivot pin
48. lever portion
50. lever portion
52. spring
54. leaf spring
56. spring end
58. rocker arm

What is claimed is:

1. An ink delivery apparatus for an inkjet printhead, comprising an ink reservoir for delivering some ink at a slight negative pressure to a printhead, a pressure regulator and an ink replenishment mechanism that maintains substantially constant negative pressure in said reservoir when some ink in said reservoir is delivered to the printhead and in response to the ink delivery replenishes some ink to said reservoir from an ink supply source, is characterized in that:

said pressure regulator and said ink replenishment mechanism includes a pressure regulator member that air-tightly covers an opening in said reservoir and is compliant to maintain substantially constant negative pressure in said reservoir, and a replenishment activator connected to said pressure regulator member outside said reservoir to avoid being exposed to the ink and which initiates an ink replenishment to said reservoir when some ink in said reservoir is delivered to said printhead.

2. An ink delivery apparatus as recited in claim 1, wherein said pressure regulator member deforms inwardly when some ink in said reservoir is delivered to the printhead and returns outwardly when some ink is replenished to said reservoir, and said replenishment activator moves to initiate ink replenishment to said reservoir when said pressure regulator member deforms inwardly and moves to terminate the ink replenishment when said pressure regulator returns outwardly.

3. An ink delivery apparatus as recited in claim 1, wherein said pressure regulator member deforms inwardly when some ink in said reservoir is delivered to the printhead and returns outwardly when some ink is replenished to said reservoir, an ink conduit empties into said reservoir, said replenishment activator includes a valve member that opens and closes said ink conduit to allow and prevent the ink replenishment to said reservoir and which is connected to said pressure regulator member to open in order to initiate the ink replenishment when said pressure regulator member deforms inwardly and to close in order to terminate the ink replenishment when said pressure regulator returns outwardly.

4. An ink delivery apparatus as recited in claim 3, wherein said valve member includes a compliant valve membrane that air-tightly covers an opening in said reservoir and when said valve member is closed caps said ink conduit to prevent ink replenishment to said reservoir, but when said valve member is opened uncaps said ink conduit to allow ink replenishment to said reservoir.

5. An ink delivery apparatus as recited in claim 4, wherein said replenishment activator includes a rocker lever pivotable between spaced lever portions one of which is connected to said pressure regulator member and another of which is connected to said compliant valve membrane in order for said lever to pivot to cause said compliant valve membrane to uncap said ink conduit when said pressure regulator member deforms inwardly and to recap said ink conduit when said pressure regulator member returns outwardly.

6. An ink delivery apparatus as recited in claim 5, wherein a spring applies a pivoting force to said rocker lever that causes said lever portion that is connected to said compliant valve membrane to hold said compliant valve membrane capping said ink conduit, but the pivoting force is light enough to be overcome when said pressure regulator member deforms inwardly.

7. An ink delivery apparatus as recited in claim 5, wherein said portion of said rocker lever that is connected to said pressure regulator member is resilient to permit that portion be deformed without pivoting said rocker lever should said pressure regulator member be deformed outwardly when said compliant valve membrane is capping said ink conduit.

8. An ink delivery apparatus as recited in claim 7, wherein said portion of said rocker lever that is connected to said pressure regulator member is a cantilevered leaf spring.

9. An ink delivery apparatus for an inkjet printhead, comprising an ink reservoir for delivering some ink at a slight negative pressure to a printhead, a pressure regulator and an ink replenishment mechanism that maintains substantially constant negative pressure in said reservoir when some ink in the reservoir is delivered to the printhead and in response to the ink delivery replenishes some ink to said reservoir from an ink supply source, is characterized in that:

said pressure regulator and said ink replenishment mechanism includes a pressure regulator membrane that air-tightly covers an opening in said reservoir and is compliant to maintain substantially constant negative pressure in said reservoir by deforming inwardly when some ink in said reservoir is delivered to the printhead and by returning outwardly when some ink is replenished to said reservoir, and a replenishment activator that is connected to said pressure regulator membrane outside said reservoir to avoid being exposed to the ink and which initiates an ink replenishment to said reservoir when said pressure regulator membrane deforms inwardly and terminates the ink replenishment when said pressure regulator membrane returns outwardly.

10. An ink delivery apparatus as recited in claim 9, wherein an ink conduit empties into said reservoir, and said replenishment activator includes a valve membrane that is compliant to open and close said ink conduit to allow and prevent the ink replenishment to said reservoir, and said pressure regulator membrane and said valve membrane are connected to one another to open said ink conduit when said pressure regulator membrane deforms inwardly and to close said ink conduit when said pressure regulator returns outwardly.

11. An ink delivery apparatus as recited in claim 10, wherein said replenishment activator includes a rocker lever that interconnects said pressure regulator membrane and said valve membrane.

12. An ink delivery apparatus for an inkjet printhead, comprising an ink reservoir for the printhead, and an ink conduit that empties into said ink reservoir, is characterized in that:

a valve membrane air-tightly covers an opening in said reservoir and normally caps said ink conduit to prevent said ink conduit from emptying into said reservoir, but is compliant to uncap said ink conduit to allow said ink conduit to empty into said reservoir.

13. An ink delivery apparatus as recited in claim 12, wherein a spring urges said valve membrane to normally cap said ink conduit.

14. An ink delivery apparatus as recited in claim 12, wherein said valve membrane caps said ink conduit substantially at said opening.

15. A method of replenishing ink in a reservoir that drains ink to a printhead in a drop-on-demand inkjet printer, comprising steps of:

deforming a compliant valve membrane to uncap an ink conduit to allow the ink conduit to replenish ink in the reservoir, when a compliant pressure regulator membrane is deformed because ink has been drained from the reservoir to the printhead; and returning the compliant valve member recap the ink conduit to prevent the ink conduit from replenishing ink in the reservoir, when the compliant pressure regulator membrane is returned once ink is replenished to the reservoir.

16. An ink delivery apparatus for an inkjet printhead comprising:

(a) an ink reservoir for delivering ink at a slight negative pressure to a printhead;

(b) a pressure regulator that maintains a substantially constant negative pressure in the ink reservoir, the pressure regulator including a flexible pressure regulator member that is sealingly affixed over an opening in the ink reservoir;

(c) a valve through which ink is supplied to replenish the ink reservoir; and (d) a valve actuator connected to the flexible pressure regulator member, the valve actuator residing outside of the ink reservoir, the valve actuator causing the valve to open when the flexible pressure regulator member deforms toward the ink reservoir and causing the valve to close when the flexible pressure regulator member deforms away from the ink reservoir.

17. An ink delivery apparatus as recited in claim 16 further comprising:

biasing means for biasing the valve to a normally closed position, the biasing means residing outside of the ink reservoir.

18. An ink delivery apparatus as recited in claim 16 further comprising:

a spring for biasing the valve to a normally closed position, the spring residing outside of the ink reservoir.

19. An ink delivery apparatus as recited in claim 16 wherein:

the pressure regulator member deforms inwardly as ink in the reservoir is delivered to the printhead and moves outwardly when ink is replenished to the reservoir through the valve, the valve actuator moving to initiate ink replenishment to the reservoir when the pressure regulator member deforms inwardly and moves to terminate the ink replenishment when the pressure regulator returns outwardly.

20. An ink delivery apparatus as recited in claim 16 further comprising:

(a) an ink supply source; and (b) a conduit from the ink supply source to the valve, the valve including a compliant valve membrane over an opening in the reservoir, the compliant valve membrane being biased to normally reside in a closed position blocking the flow of ink through the valve.

21. An ink delivery apparatus as recited in claim 20 wherein:

the valve actuator includes a rocker including a first lever portion engaging the flexible pressure regulator member and a second lever portion engaging the compliant valve membrane, the rocker lever being pivotally connected to the ink reservoir between the first portion and the second portion such that when the flexible pressure regulator member deforms inwardly, the rocker lever pivoting to allow the compliant valve membrane to move to an open position to allow ink to flow into the ink reservoir.

22. An ink delivery apparatus for an inkjet printhead comprising:

(a) an ink reservoir;

(b) an ink conduit through which ink is delivered into the ink reservoir;

(c) a valve membrane affixed over an opening in the ink reservoir, the valve membrane being biased with a spring that resides outside of the ink reservoir to normally reside in a first position that blocks the flow of ink through the ink conduit into the ink reservoir, the valve membrane moving a second position that allows ink to flow through the ink conduit into the ink reservoir when the ink in the ink reservoir needs to be replenished.

23. An ink delivery apparatus as recited in claim 22 further comprising:

a pressure regulator member that deforms inwardly as ink in the ink reservoir is delivered to the printhead and moves outwardly when ink is replenished to the reservoir through the valve, a valve actuator moving to initiate ink replenishment to the reservoir when the pressure regulator member deforms inwardly, and the valve actuator moving to terminate the ink replenishment when the pressure regulator member moves outwardly.

24. An ink delivery apparatus as recited in claim 23 further comprising:

the valve actuator including a rocker having a first lever portion engaging the flexible pressure regulator member and a second lever portion engaging the valve membrane, the rocker lever being pivotally connected to the ink reservoir between the first portion and the second portion such that when the flexible pressure regulator member deforms inwardly, the rocker lever pivoting to allow the valve membrane to move to an open position to allow ink to flow into the ink reservoir.

25. An ink delivery apparatus for an inkjet printhead comprising:

(a) an ink reservoir for delivering ink at a slight negative pressure to the printhead;

(b) a pressure regulator affixed to the ink reservoir that maintains the ink reservoir at a substantially constant negative pressure, the pressure regulator including a pressure regulator membrane that is sealingly attached over an opening in the ink reservoir, the pressure regulator membrane deforming toward the ink reservoir when the ink reservoir requires replenishment, and deforming away from the reservoir when the ink reservoir does not require replenishment;

(c) an ink replenishment valve actuator affixed to the pressure regulator membrane, the ink replenishment valve actuator residing outside of the ink reservoir; and (d) a valve through which ink is supplied to the ink reservoir, the ink replenishment valve actuator opening the valve when the pressure regulator membrane deforms toward the ink reservoir and closing the valve when the pressure regulator membrane deforms away from the ink reservoir.

* * * * *